US007214004B2

(12) United States Patent
Javanbakhsh

(10) Patent No.: US 7,214,004 B2
(45) Date of Patent: May 8, 2007

(54) MOBILE FLOOD WALL

(76) Inventor: Hasan Javanbakhsh, Dreikonigenstr. 50, 50678, Koln (DE)

( * ) Notice: Subject to any disclaimer, the term of this patent is extended or adjusted under 35 U.S.C. 154(b) by 0 days.

(21) Appl. No.: 11/178,213

(22) Filed: Jul. 8, 2005

(65) Prior Publication Data

US 2007/0009326 A1 Jan. 11, 2007

(51) Int. Cl.
*E02B 7/02* (2006.01)

(52) U.S. Cl. ..... 405/114; 405/107; 405/15; 405/21

(58) Field of Classification Search ..... 405/107, 405/114, 115, 15, 21, 23, 22, 25, 30
See application file for complete search history.

(56) References Cited

U.S. PATENT DOCUMENTS

| | | | | |
|---|---|---|---|---|
| 3,869,868 | A | 3/1975 | Irsai | |
| 4,031,676 | A * | 6/1977 | Dally | 405/107 |
| 4,129,006 | A * | 12/1978 | Payne | 405/31 |
| 4,669,913 | A * | 6/1987 | Temple | 405/15 |
| 4,784,520 | A * | 11/1988 | Stevens | 405/21 |
| 5,176,468 | A * | 1/1993 | Poole | 405/23 |
| 5,899,632 | A * | 5/1999 | Martin | 405/25 |
| 5,971,661 | A * | 10/1999 | Johnson et al. | 405/114 |
| 6,334,736 | B1 * | 1/2002 | Johnson et al. | 405/114 |
| 6,672,799 | B2 * | 1/2004 | Earl | 405/111 |
| 6,679,654 | B1 * | 1/2004 | Wittenberg et al. | 405/115 |

FOREIGN PATENT DOCUMENTS

| | | | |
|---|---|---|---|
| DE | 8201374 | U1 | 9/1982 |
| DE | 19804662 | A1 | 9/1999 |
| DE | 10150902 | A1 | 1/2003 |
| EP | 0854238 | A2 | 7/1998 |
| EP | WO01/81681 | A1 | 11/2001 |

* cited by examiner

*Primary Examiner*—Frederick L. Lagman
(74) *Attorney, Agent, or Firm*—John F.A. Earley III; Frank J. Bonini, Jr.; Harding, Earley, Follmer & Frailey

(57) ABSTRACT

Mobile flood wall preferably comprising of plastic, characterized by support elements (1 through 5) as plates of a fitting thickness, each in the form of an equilateral triangle with one of the three equal outer sides as the base and wall elements (11 through 19) as rectangular plates of a fitting thickness lying on and connected to the water-side outer side of the equilateral support elements and therefore sloped at an angle of 60°, which forms the wall with the land side surface, wherein the water pressure on the wall elements is diverted by the support elements into the ground, and causes the surface structures of the base of the support elements to be pressed into and anchored in the ground, for sealing the ground against water and for the stability and the nondisplaceability of the flood wall.

7 Claims, 2 Drawing Sheets

MOBILE FLOOD WALL

BACKGROUND OF THE INVENTION

Floods have always required protective measures in the form of man-made structures where flooding of the threatened areas would lead to danger to humans and animals.

However, unusually extremely high water levels have occurred in increasing numbers for the past few years.

Among other things, changes in the climate, the regulation and narrowing of river beds, the use of water meadows as drainage zones for growing crops and the increasingly extensive surface sealing of the landscape have contributed to this serious development.

Therefore, an increasing need for additional and more effective measures can be seen, which can halt and prevent flooding in private and public areas in the long term and also in the short term.

The traditional protection and raising of river banks are masonry or heaped-up dike and river bank forms of a corresponding weight, consistency and slope angle as a permanent and immobile protection against floods.

These are usually built on the banks of rivers in municipal areas in terms of height and shape such that according to empirical values, they can prevent flooding of the river bank areas in the range of floods that occur and do not interfere with the visibility conditions at normal water levels.

Centuries-old town and city centers have developed and expanded as trade routes on the banks of rivers and the building of structures in the area of the banks must be correspondingly adapted aesthetically and functionally. In many areas, a steady increase in the height of the structures protecting river banks would unacceptably damage the quality of the built-up environment.

Mobile systems that can be deployed and also dismantled in a short time for supplementing the permanent structures built are therefore meaningful and necessary for the protection of public and private river bank areas from extreme flood levels occurring at an increased frequency.

Dams built up from sand bags and films or prepared foundations for supports, on which, for example, Europallets, supplemented by films, form protective walls that can be erected and dismantled in a short time, have been known.

Also known are Aqua Stop flood walls made of aluminum as supports, which are bolted on existing concrete foundations and then form a protective wall with walls arranged in between, which are made of horizontal dam girders and corresponding seals.

These prior-art devices for protection against floods are frequently characterized by the high weight of their component parts, which requires great effort in terms of manpower and machinery for the erection of longer sections in a short time.

Mobile systems, which require prefabricated foundations, cannot be used, in turn, in a flexible manner due to the fact that they are characteristically bound to a site and compromise the quality and the functionality of the areas requiring protection during periods without flood.

SUMMARY OF THE INVENTION

An object of the invention is to provide mobile flood protection that can be erected in a short time by the use of reusable, lightweight and therefore easy-to-transport and easy-to-erect parts, which can be erected and adapted without technical problems, without tools and without comprehensive instructions by any person, male or female, on nearly any soil. This object and other objects are provided by my invention which is set out below.

Figure 1B:
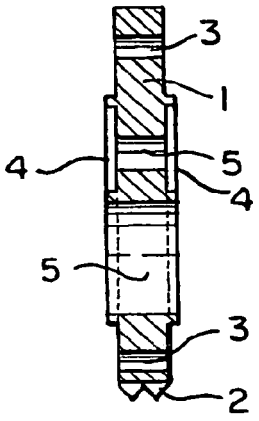
FIG. 1*b*—1*b* shows a vertical section of the support element taken along the lines and arrows 1*b*—1*b* shown in FIG. 1*a*.
Figure 1A:
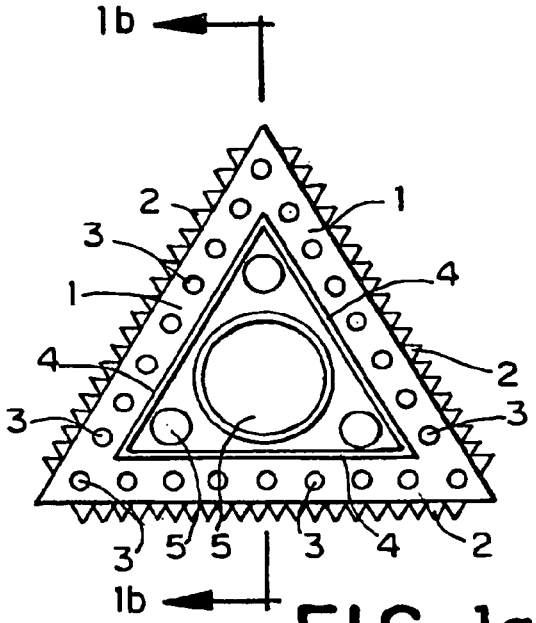
FIG. 1*a* shows a view of the support element.
Figure 1C:
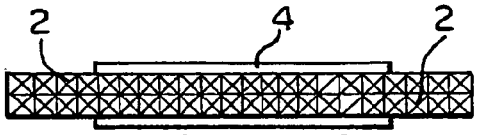
FIG. 1*c* shows a top view of the outer side of the support element.
Figure 7:
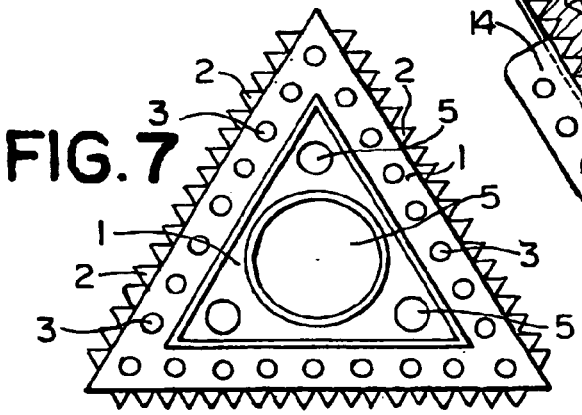
FIG. 7 shows a view of the support element.
Figure 8:
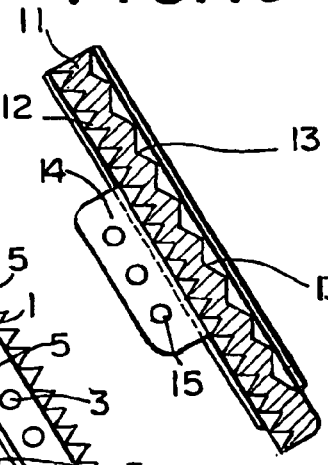
FIG. 8 shows a vertical section of the wall element.
Figure 9:
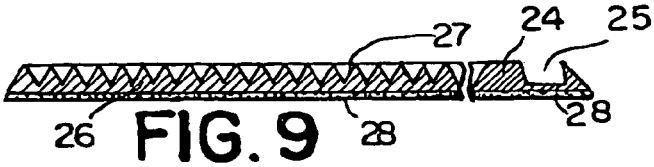
FIG. 9 shows a horizontal section of the geomat with the sealing part at the low end of the wall element.
Figure 10B:
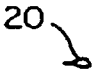
FIG. 10*b* shows a top view of the sealing tape.
Figure 2B:
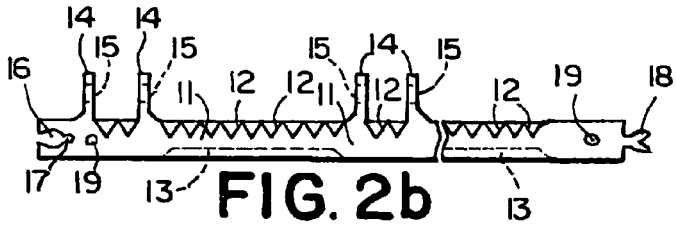
FIG. 2*b* shows a top view of the wall element.
Figures 2C, 10A:
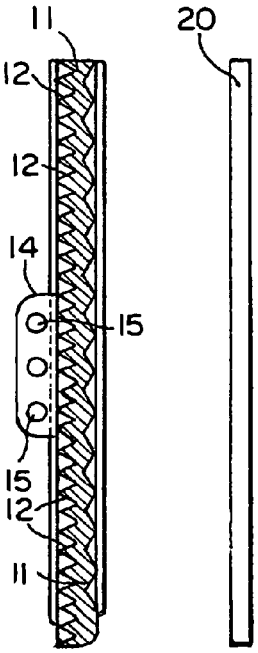
FIG. 2*c*—2*c* shows a vertical section of the wall element taken along the lines and arrows 2*c*—2*c* shown in FIG. 2*a*.
FIG. 10*a* shows a vertical section of the sealing tape.
Figure 2A:
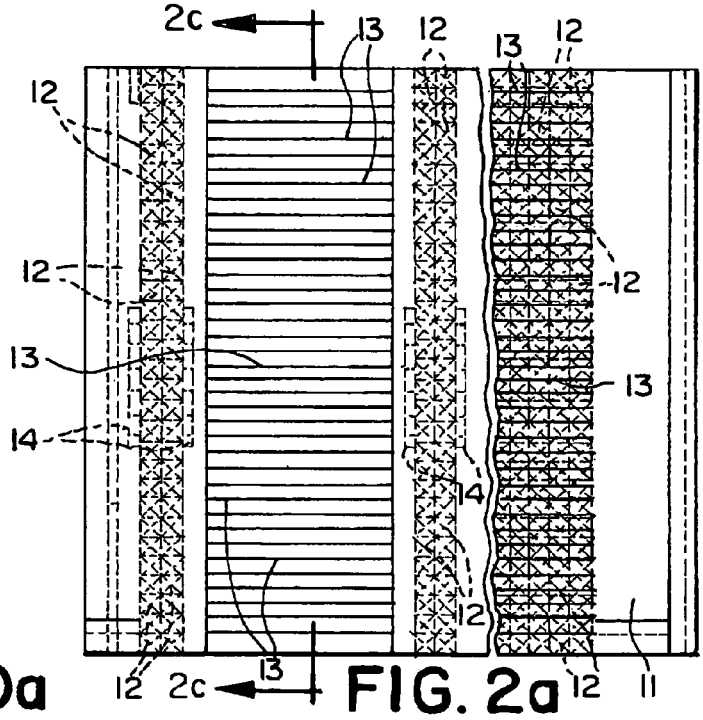
FIG. 2*a* shows a view of the water side of the wall element.
Figure 3:
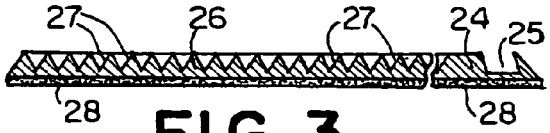
FIG. 3 shows a geomat with sealing part at the low end of the wall element.
Figure 4:
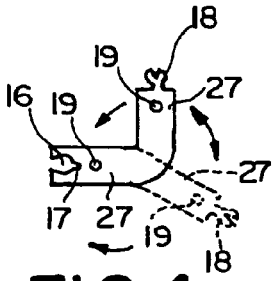
FIG. 4 shows an elastic corner connection for wall elements with an angle of 90° or another angle.
Figure 5:
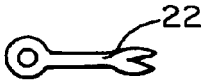
FIG. 5 shows bolts for connecting the support elements to the wall elements.
Figure 6:
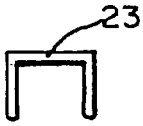
FIG. 6 shows clamps for connecting two wall elements at the upper edge.

The invention pertaining to a mobile flood wall, which arises from this development idea, comprises wall elements that can be assembled on the site and are complemented with support elements such that they form a flood protection system with novel advantageous properties.

Support elements 1 through 5 form together an equilateral triangle preferably consisting of a plastic in a plate-like manner as a whole with three outer sides of equal, specially structured surface.

They are used to support the flood wall at an angle of 60°, which forms the wall with the land side surface, each of the three outer sides of the support elements 1 being able to be used as the base as desired.

These three equal outer sides of the support elements are structured as square grids of preferably two or three parallel rows of pyramid-shaped expansions of the surface as square pyramids 2 with lateral edges of equal length, likewise as equilateral triangles and with corresponding depressions of identical shape located in between as the structure of the surface 2 of the underside of the support elements, fittingly for meshing with the identical surface structures 12 of the land sides of the wall elements 11.

Depending on the material, round openings 3, which frame the inner, likewise equilateral triangular area, are left in the three edge areas of the three sides of the support elements 1.

Within the three edge areas with round openings, the surface of the support elements is expanded by an inner equilateral triangular frame shape 4 on both sides as a circumferential thickening of the plate shape of the support element and as a circumferential additional support of disk-shaped expansions 14 of the wall elements for connection to wall elements.

The triangular area within this thickening is interrupted by a central round opening 5 also for easier handling during transportation and may have additional round openings 5 depending on the material and the dimensions.

Wall elements 11 through 19 are shaped as rectangular plates, preferably plastic plates, with identical upper and lower halves, and orientation toward the differently structured land side and water side is therefore sufficient during erection.

They have a horizontally corrugated surface 13 on the water side as rounded channel-shaped openings preferably in the sections between the connection sections for land-side support elements.

The wall-high sections at the two ends of each wall element 11 with the openings and expansions for connecting the wall elements are of greater thickness on the land side and on the water side.

The land-side surface of the wall elements 11 is structured as a square grid of preferably two or more pyramid-shaped expansions 12 of the surface as square pyramids with lateral edges of equal length likewise as equilateral triangles and with corresponding depressions of identical shape located in between as the structure of the surfaces of the sections between the connection sections for land-side support elements fittingly for meshing with the surface structures 2 of the outer sides of the support elements.

The land-side wall-high sections between land-side disk pairs 14 are structured in the same manner as square grids 12 for connection to the surface structures 2 of the outer sides of the support elements.

The vertical disk pairs 14 expand the land side of the wall elements 11 at right angles to the surface with respective round holes 15 located opposite each other fitting the round holes 3 in the equilateral edge frame of the support elements 1.

The edge frames of the support elements can be inserted as desired with one of the three sides of each support element being positioned between the disk pairs, and are connected to the wall elements in a fitting height position by bolts 22 pushed into the round holes 3, 15.

The land side is smooth and unstructured in the section under and above the two disks 14.

Wall elements 11 are connected to the support elements 1 by the frames of the support elements being inserted between the disk pairs 14 of the wall elements and connected with bolts 22 pushed through via the round holes 3, 15 and fastened in a nondisplaceable manner. Supported wall elements are thus displaceable upwardly and downwardly from one round hole to the next with the disk pairs of the wall elements as rails, by the bolts being pulled out, the wall element is brought into the desired height position depending on the topography, and the bolts are again pushed in.

Connection of the Wall Elements to One Another Linearly and at an Angle

The wall elements are connected linearly via a wall-high snap closure 16 through 18 with a sealing tape 20 of drop-shaped cross section, which presses the snap closure 18 against the cavity 16. Besides the linear connection, wall elements may also be connected to one another at other angles by an elastic, wall-high connection element 21 as a wall section of a width and thickness selected depending on the material and the angular position and with a snap closure technique at the ends as in the case of the linear connection 16 through 18.

Additional connection elements in the form of a clamp 23 may be inserted into round holes 19 as central openings in the left-hand and right-hand edge areas of the top side of the wall elements 11, 21 for the additional connection of the wall elements to one another.

Technique for Connecting the Support Elements to the Ground Intermediate Mat as a Ground Seal In case of grounds of high strength (stone, pavement, tar, etc.), an additional intermediate mat 26 with a surface structure 27 can be inserted fittingly to the meshing with the underside of the support elements 2 for a more effective sealing, friction and adhesion to the subsoil.

This mat may consist of different materials and be cut fittingly to size depending on the needs and the topography with corresponding thickness and material properties and structure of the underside of the intermediate mat 28 to enable it to be adapted to the particular subsoil.

Low End of Wall Element/Support Element

For sealing against water especially in case of grounds with high strength, a sealing section 24, 25 can be used at the low end of the wall element/support element of the assembled flood wall in a positive-locking manner as a closure of the intermediate mat fittingly to the pyramid shape of the surface structure of the corner point of the lower side of the support element and the low end of the wall element.

This sealing profile may consist of different materials with a corresponding thickness and material properties and structure of the underside of the sealing profile 28 to enable it to be adapted to the particular subsoil.

The water pressure on the wall plates is absorbed by the triangular support elements and it presses the meshing of the underside of the leg lying on the ground into the ground to ensure the stability and nondisplaceability of the flood wall.

In case of grounds with high strength, an intermediate mat under the base of the support elements ensures adhesion in some sections over the entire area depending on the consistency and the surface structure of the subsoil.

The height of individual wall plates can be adjusted depending on the topography when the bolts are removed from the round openings of the two disk-shaped expansions of the wall elements and the meshing will separate upon vertical pulling or pushing of the corresponding wall plate and snaps into the next higher or next lower meshing segment of the support element and wall element and the bolts are then again inserted into the round openings of the two disk-shaped expansions of the wall elements in this height position. Gaps that may possibly develop at the lower edge of a wall element due to points on the soil that cannot be leveled off in a short time can be closed, for example, with sand bags.

Additional support elements may also be inserted between the disks and reinforce the flood wall as needed, meshed with the land side of the wall elements.

Working Steps for Erecting the Mobile Flood Wall of the Subject of the Application Delivery and at the same time ground preparation on the site, erection and connection of a wall element to support elements, more ground preparation on the left and right and adding additional wall elements with support elements on both sides, and connection with the adaptation possibilities of the parts depending on the nature of the ground, differences in height and obstacles in the terrain and according to the water level.

ADVANTAGES

The subject of the application preferably consists as a whole of plastic or aluminum and therefore it has a low own weight, which makes possible lighter and more rapid transportation, erection, disassembly and conversion on the site.

Rapid orientation during erection is possible due to equal outer sides of the support elements and erection of the wall elements toward the water side and the land side only.

The parts can be assembled and adapted without tools and without extensive instructions by any person, male or female, on nearly any soil.

No prefabricated foundations are necessary, and the subject of the application can therefore also be used in an especially flexible manner in space.

The parts can be cleaned without effort by spraying with water to ensure reusability as a finished part.

The material can be stored in a simple manner and, due to the plate shape of the elements, in a space-saving manner.

The invention claimed is:

1. Mobile flood wall system for mounting on a surface, comprising support plates of a fitting thickness, each support plate having a shape of an equilateral triangle, and each support plate having three side end portions with any one of the three side end portions acting as a base side of the triangle, the three side end portions of each support plate having a structured surface, and wall elements comprising rectangular plates of a fitting thickness for lying on and being connected to the support plates at the side end portions of the support plates oriented toward water to be blocked by the mobile flood wall system when assembled, each wall element being sloped at an angle of 60 degrees with respect to the base side of the triangle, the wall elements when mounted on the support plates forming a barrier with the surface on which the flood wall system when assembled is mounted, wherein water pressure on the wall elements is diverted by the support plates into the surface on which the flood wall system when assembled is placed and causes the structured surfaces of the side end portions of the support plates acting as the base sides to be pressed into and anchored in the surface on which the flood wall system when assembled is mounted for sealing the surface against water and for adding stability and nondisplaceability to the flood wall system when assembled, the structured surface of the side end portions of the support plates having pyramid-shaped expansions having square pyramids with lateral edges of equal length, and depressions located in between the pyramids, for meshing with the wall elements, the support plates further having round openings formed therethrough, which frame an inner equilateral triangular area of the support plate, the round openings being equally spaced in edge areas of the support plate outside the inner equilateral triangular area of the support plate, the thickness of the support plate at the triangular area being expanded by an inner equilateral triangular frame, wherein the triangular area is interrupted by a central round opening to facilitate handling of the support plate during transportation.

2. Mobile flood wall system in accordance with claim 1, characterized in that in case of the surface that the flood wall system when assembled is to be mounted has high strength, an additional intermediate mat with a surface structure may be fittingly inserted for meshing with the underside of the support for more effective sealing, friction and adhesion to the surface that the flood wall system when assembled is to be mounted, and that a sealing section may be inserted under the wall element and the support plate of the flood wall system when assembled.

3. Mobile flood wall system in accordance with claim 1, the wall elements being connectable linearly to one another via a wall-high snap closure, mounted on the wall elements, secured to a sealing tape of drop-shaped cross section, and being connectable to one another at different angles by an elastic, wall-high connection element.

4. Mobile flood wall in accordance with claim 1, characterized by additional connection elements in the form of clamps for connecting the wall elements to one another, which may be inserted into round holes as central openings in left-hand and right-hand edge areas of top end portions of the wall elements.

5. Mobile flood wall system for mounting on a surface, comprising support plates of a fitting thickness, each support plate having a shape of an equilateral triangle, each support plate having three side end portions with any one of the three side end portions acting as a base side of the triangle, the three side end portions of each support plate having a structured surface and each support plate having round openings formed therethrough, and wall elements comprising rectangular plates of a fitting thickness for lying on and being connected to the support plates at the side end portions of the support plates oriented toward water to be blocked by the mobile flood wall system when assembled, each wall element being sloped at an angle of 60 degrees with respect to the base side of the triangle, the wall elements when mounted on the support plates forming a barrier with the surface on which the flood wall system when assembled is mounted, wherein water pressure on the wall elements is diverted by the support plates into the surface on which the flood wall system when assembled is placed and causes the structured surfaces of the side end portions of the support plates acting as the base sides to be pressed into and anchored in the surface on which the flood wall system when assembled is mounted for sealing the surface against water and for adding stability and nondisplaceability to the flood wall system when assembled, the wall elements having front surfaces for facing water to be blocked by the flood wall system when assembled, and rear surfaces, the wall elements having identical upper halves and lower halves, the wall elements having horizontally corrugated surfaces formed on the front surfaces and structured surfaces formed on the rear surfaces, the structured surfaces having pyramid-shaped expansions having square pyramids with lateral edges of equal length, and depressions located in between the pyramids, for meshing with the structured surfaces of the support plates, and the rear surfaces of the wall elements further having disk pairs extending rearwardly therefrom and bracketing the structured surfaces formed on the rear surfaces of the wall elements for use in connecting the structured surfaces of the support plates to the structured surfaces of the wall elements, the structured surfaces of the support plates being structured in the same manner as the structured surfaces of the wall elements, the disk pairs having a pair of round holes aligned opposite one another which may be aligned with any of the round holes formed in any of the support plates to position wall elements at a desired height on the side end portions of the support plates, each disk pair being secured to a support plate by a bolt inserted through the holes in the disk pair and the hole in the support plate after the holes in the disk pair have been aligned with a hole in the support plate.

6. Mobile flood wall system in accordance with claim 5, the structured surfaces of the wall elements and the support plates forming meshing surfaces that may mesh together, characterized by the adjustment of the heights of individual wall elements depending on the topography, wherein wall elements are displaceable upwardly and downwardly, with the disk pairs of the wall elements acting as rails, by first pulling out the bolts, bringing the wall elements into the desired position in height by the meshing surfaces of the wall elements and the support plates being separated by vertically pulling or pushing the wall elements along the rails and by the meshing surfaces of the wall elements and the support plates that correspond to one another snapping into adjacent portions of the meshing surfaces of the support plates and wall elements, and finally reinserting the bolts.

7. Mobile flood wall system in accordance with claim 5, characterized by additional support elements, which are inserted between the disk pairs of the wall elements and reinforce the flood wall system when assembled as needed.

* * * * *